US007487924B2

(12) United States Patent
Johnson

(10) Patent No.: US 7,487,924 B2
(45) **Date of Patent: *Feb. 10, 2009**

(54) SPRAY NOZZLE

(76) Inventor: Thomas Les Johnson, 7060 Knollwood Dr., Moundsview, MN (US) 55112

( * ) Notice: Subject to any disclaimer, the term of this patent is extended or adjusted under 35 U.S.C. 154(b) by 253 days.

This patent is subject to a terminal disclaimer.

(21) Appl. No.: 10/873,468

(22) Filed: Jun. 21, 2004

(65) Prior Publication Data

US 2004/0227015 A1 Nov. 18, 2004

Related U.S. Application Data

(62) Division of application No. 10/068,652, filed on Feb. 6, 2002, now Pat. No. 7,108,204.

(51) Int. Cl.
*B05B 17/00* (2006.01)

(52) U.S. Cl. ..... 239/1; 239/522; 239/523; 239/512; 239/504; 239/509; 239/514; 239/595; 239/505

(58) Field of Classification Search ..... 239/592, 239/595, 524, 523, 522, 513, 512, 509, 506, 239/505, 501, 504, 518, DIG. 1, 1
See application file for complete search history.

(56) References Cited

U.S. PATENT DOCUMENTS 1,639,162 A 8/1927 Brooks
1,805,782 A * 5/1931 Munz ..... 239/498
2,338,273 A 1/1944 Wilkins
RE24,353 E * 9/1957 Kromer ..... 239/505
2,864,652 A * 12/1958 O'Brien et al. ..... 239/523
3,085,754 A 4/1963 Thompson
3,468,484 A * 9/1969 Hunter ..... 239/204
4,168,033 A * 9/1979 von Bernuth et al. ..... 239/523
4,461,426 A 7/1984 Christopher
4,624,414 A 11/1986 Ferrazza
4,828,182 A * 5/1989 Haruch ..... 239/432
5,076,497 A 12/1991 Rabitsch

OTHER PUBLICATIONS

Catalog—W.L. Hamilton & Co., Marshall, Michigan, 1986, pp. 17, 18 and 23.
Catalog—Kuker Industries , Inc., Omaha, Nebraska, 1994, pp. 54 and 57.

* cited by examiner

*Primary Examiner*—Dinh Q Nguyen
(74) *Attorney, Agent, or Firm*—Altera Law Group, LLC

(57) ABSTRACT

A spray nozzle includes an orifice disposed on a substantially planar discharge surface. An impingement surface is disposed opposite the orifice, the impingement surface forming an angle with a centerline of the orifice. The angle between the orifice centerline and the surface is less than 90 degrees. A deflection ridge bridges a gap between the impingement surface and the discharge surface. The deflection ridge encompasses a partial circumference of the nozzle. The nozzle includes a fluid fitting adapted for providing a pressurized fluid to the orifice.

25 Claims, 6 Drawing Sheets

SPRAY NOZZLE

This application is a divisional of application Ser. No. 10/068,652, filed 6 Feb. 2002 now U.S. Pat No. 7,108,204. The application is incorporated herein by reference.

FIELD OF THE INVENTION

The invention relates generally to spray nozzles, and more particularly to nozzles evenly dispersing fluid in a generally planar sector. An improved nozzle according to the present invention can more evenly distribute a fluid over the area covered by nozzle's spray pattern than previous designs.

BACKGROUND OF THE INVENTION

Spray nozzles used for dispersing fluids are well known. In agricultural applications, nozzles that can evenly disperse a liquid agent (fertilizer, insecticide, water, etc) are especially useful. The accuracy and consistency of nozzle spray patterns are important in modern systems due to advances in the agricultural sciences. For example, satellite surveys of fields can be used to direct GPS located vehicles for the accurate dispersion of agents on a crop, the dispersion pattern based on an analysis of the satellite survey. Given the precise distribution required by such a system, a nozzle that can accurately and consistently deliver an agent over a given area is highly desirable.

Flow through nozzles is typically quite turbulent. In the case of a liquid being discharged into the atmosphere, two-phase fluid interface conditions also exist. As a result, accurate modeling of nozzle performance by analytical means is highly complex, and may not feasible. Therefore, optimization of nozzle performance generally requires testing various geometries by trial and error. In such testing, seemingly innocuous changes to geometry can make a significant difference in nozzle performance.

There is a need for a spray nozzle with superior dispersion characteristics. Especially desirable is a nozzle that can evenly distribute a fluid over the nozzle's spray area. The present invention fulfills these and other needs, and provides several advantages over prior spray nozzle systems.

SUMMARY OF THE INVENTION

To overcome the limitations in the prior art described above, and to overcome other limitations that will become apparent upon reading and understanding the present specification, the present invention discloses a spray nozzle design.

In one embodiment, a spray nozzle includes a discharge surface and an orifice disposed on the discharge surface. An impingement surface oppositely faces the orifice. The impingement surface is oriented at an impingement angle measured relative to a centerline of the orifice, the impingement angle being 90 degrees or less. The spray nozzle further includes a deflection ridge. The deflection ridge bridges a gap between the impingement surface and the discharge surface and defines a spray angle which limits the discharge of fluid. A fluid fitting is in fluid connection to the orifice. The fluid fitting is adapted to receive a pressurized fluid.

In one configuration, the impingement angle is generally 85 degrees. The deflection ridge may include a filleted corner, and the filleted corner can be formed to smoothly join with the impingement surface. Alternatively, the deflection ridge includes two filleted corners, the filleted corners intersecting at an angle defining a spray angle. The two filleted corners can be made to smoothly join with the impingement surface. The spray angle defined by the corners is about 100 degrees to about 160 degrees.

In another configuration, the deflection ridge includes a filleted corner and a sharp corner, the filleted corner and the sharp corner intersecting at an angle defining a spray angle. The spray angle is about 80 degrees to about 120 degrees. The interface between the filleted corner and the impingement surface may include a sharp ridge. The filleted corner can be made to extend past the intersection of the filleted corner and the sharp corner and forming a spherical indentation therein. The sharp corner may include a trailing edge curve extending towards the filleted corner at a distal end of the sharp corner. The sharp corner may also include a leading edge curve extending away from the filleted corner at the intersection of the filleted corner and the sharp corner.

In another embodiment of the present invention, a spray nozzle system includes a body having a discharge surface, an orifice disposed on the discharge surface, and a fluid fitting in fluid connection to the orifice. The fluid fitting adapted to receive a pressurized fluid. A spray head is mountable to the body. The spray head includes an impingement surface, the impingement surface oppositely facing the discharge surface. The impingement surface is oriented at an impingement angle measured relative to a centerline of the orifice, the impingement angle being 90 degrees or less. A deflection ridge bridges a gap between the impingement surface and the discharge surface, the deflection ridge defining a spray angle which limits the discharge of fluid. The spray head can be configured to be removable from the body and/or interchangeable on the body.

In another embodiment of the present invention, a method of dispersing fluid involves discharging a pressurized fluid from an orifice on a discharge surface. The fluid is deflected at an impingement surface to form an impingement flow. The impingement surface is oriented at a deflection angle measured relative to a centerline of the orifice, the angle being less than 90 degrees. The impingement flow is deflected to limit an exit plume to a limited circumferential angle.

Limiting the exit plume to a limited circumferential angle may further involve deflecting the impingement flow using a filleted corner, or using two filleted corners, the filleted corners intersecting at an angle defining a spray angle. In another aspect, limiting the exit plume to a limited circumferential angle further involves using a filleted corner and a sharp corner, the filleted corner and the sharp corner intersecting at an angle defining a spray angle. The fluid can be pressurized in a range from about 25 psi to about 35 psi.

In another embodiment of the invention, a spray nozzle includes a body having a substantially planar discharge surface. A fluid fitting is included on an end of the body away from the discharge surface. An orifice is disposed on the discharge surface and in fluid connection with the fluid fitting. A spray head is removably attached to the body. The spray head includes a substantially planar sealing surface interfaceable with the discharge surface of the body. The sealing surface has a generally triangular shape with a triangular base and a rounded triangular tip opposite the triangular base. A planar impingement surface is indented in the sealing surface. The impingement surface oppositely faces the orifice when the spray head is attached to the body. The impingement surface is oriented at an impingement angle measured relative to a centerline of the orifice, the impingement angle being 90 degrees or less. The spray head includes a deflection ridge at the intersection of the impingement surface and the sealing surface. The deflection ridge is at least in part adjacent to the triangular base of the sealing surface.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

Figure 1:
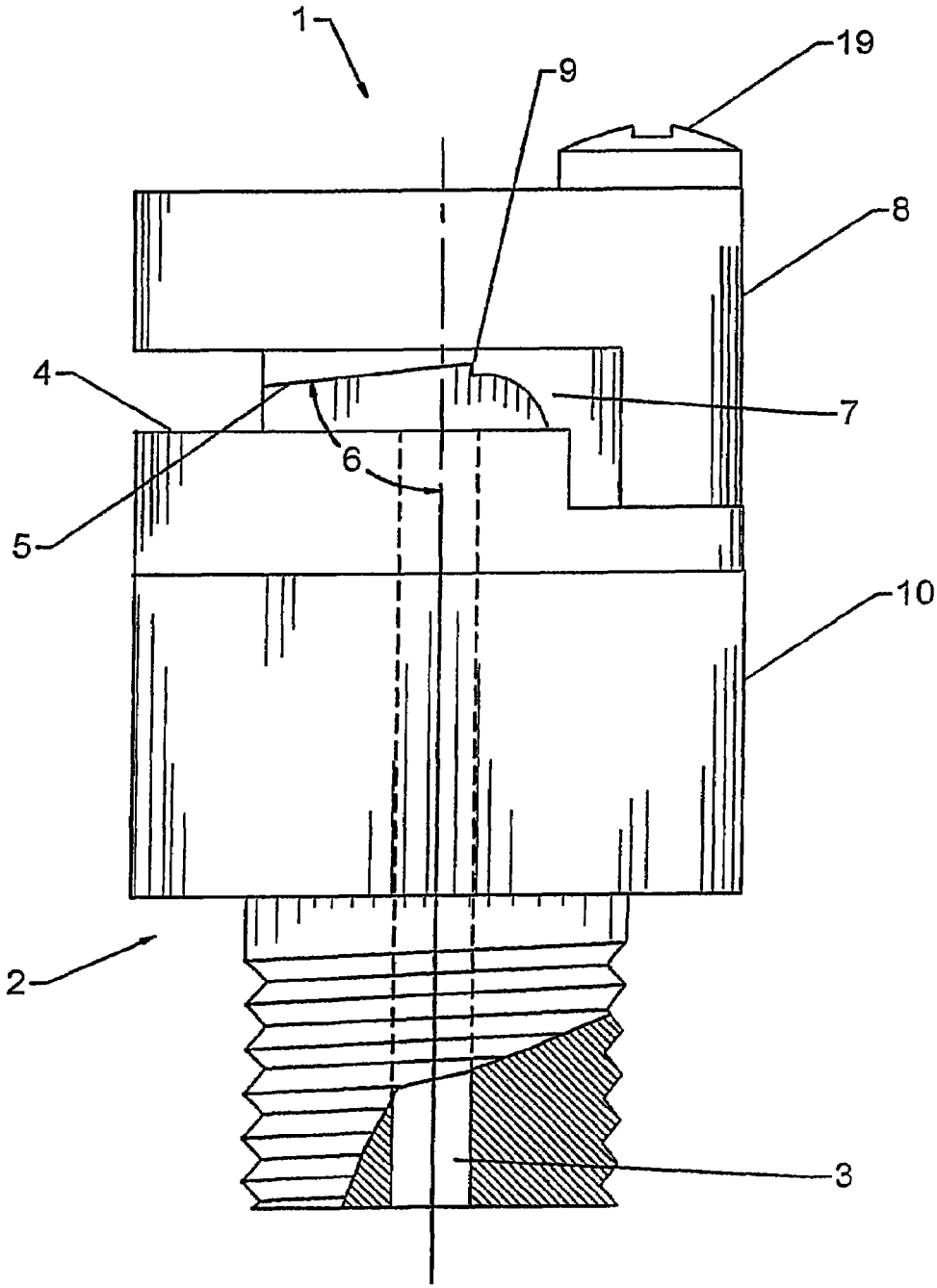
FIG. 1 is a side view of a nozzle according to the present invention.

While the invention is amenable to various modifications and alternative forms, specifics thereof have been shown by way of example in the drawings and will be described in detail herein. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF THE VARIOUS EMBODIMENTS

In the following description of the illustrated embodiments, references are made to the accompanying drawings which form a part hereof, and in which is shown by way of illustration, various embodiments in which the invention may be practiced. It is to be understood that other embodiments may be utilized, and structural and functional changes may be made without departing from the scope of the present invention.

Turning to FIG. 1, a side view of a nozzle, generally designated by reference numeral 1, is illustrated. The nozzle 1 includes a fluid fitting 2 which allows the nozzle 1 to be mounted to a fixture (e.g. a pipe or spray boom). The fluid fitting 2 also provides a fluid connection for the orifice 3. The orifice 3 allows fluid to pass from the fluid fitting 2 to where it exits at the discharge surface 4.

The discharge surface 4 is oriented substantially perpendicular to the orifice 3, the discharge surface having a peripheral edge at its outer extent as shown in FIG. 1 (roughly where lead line 4 contacts it). The discharge surface 4 as shown in FIG. 1 is substantially planar. Opposite the discharge surface 4 is the impingement surface 5 which as shown in FIG. 1 has a peripheral edge (roughly where lead line 5 contacts it). Notice that FIG. 1 shows that the peripheral edge of discharge surface 4 extends beyond the impingement surface 4 so the fluid passing along the impingement surface will necessarily flow along the discharge surface after it passes the peripheral extent of said impingement surface 5. The impingement surface 5 is oriented at an angle 6 relative to the centerline of the orifice 3. Orienting the impingement surface 5 at an impingement angle 6 less than 90 degrees provides a restriction for fluid flowing between the discharge surface 4 and impingement surface 5. It is understood that a range of angles can be defined between an arbitrarily oriented line and surface (e.g. plane), and the impingement angle 6 is the smallest angle that can be formed between the orifice centerline and the impingement surface 5.

Fluid exiting the orifice 3 will impact the impingement surface 5. The impinging fluid forms an impingement flow upon striking the impingement surface 5. Impingement flow is an external flow (e.g. stream or jet) that is redirected due to impacting a surface at an impingement point. The impingement flow appears as a thin sheet of fluid that spreads out in all directions across the impinged surface from the impingement point. Part of the impingement flow in the nozzle 1 is forced directly out the gap between the impingement surface 5 and the discharge surface 4. Fluid is blocked in other directions by the deflection ridge 7. The deflection ridge 7 bridges the gap between the impingement surface 5 and the discharge surface 4, thereby limiting the flow to a partial circumferential angle (i.e. less that 360 degrees) around the nozzle 1 and as shown in FIG. 1 has an upper edge opposing and spaced apart from the discharge surface 4 and a lower edge extending from the planar discharge surface 4 which limits the fluid flow by its curved surface. As shown in FIG. 1, the deflection ridge 7 can be formed at least in part by a fillet between the impingement surface 5 and the body of the spray head 8. The deflection ridge 7 in this embodiment interfaces with the impingement surface 5 at sharp ridge 9.

The fluid plume exiting the nozzle is formed of two flow components. The first flow component is impingement flow that directly exits the nozzle 1. The second flow component includes impingement flow that hits the deflection ridge 7 and is thereby deflected out the nozzle 1 along the discharge surface as shown in FIG. 1 which is the only possible exit path. Since these two flow components have different paths, they will achieve different states (e.g. velocities) when exiting the nozzle 1. By careful design of geometric features (e.g size and shape of the impingement surface 5 and deflection ridge 7), these two flow components can be tuned such that the resultant flow has even dispersion characteristics over an area covered by the nozzle plume.

Figure 2:
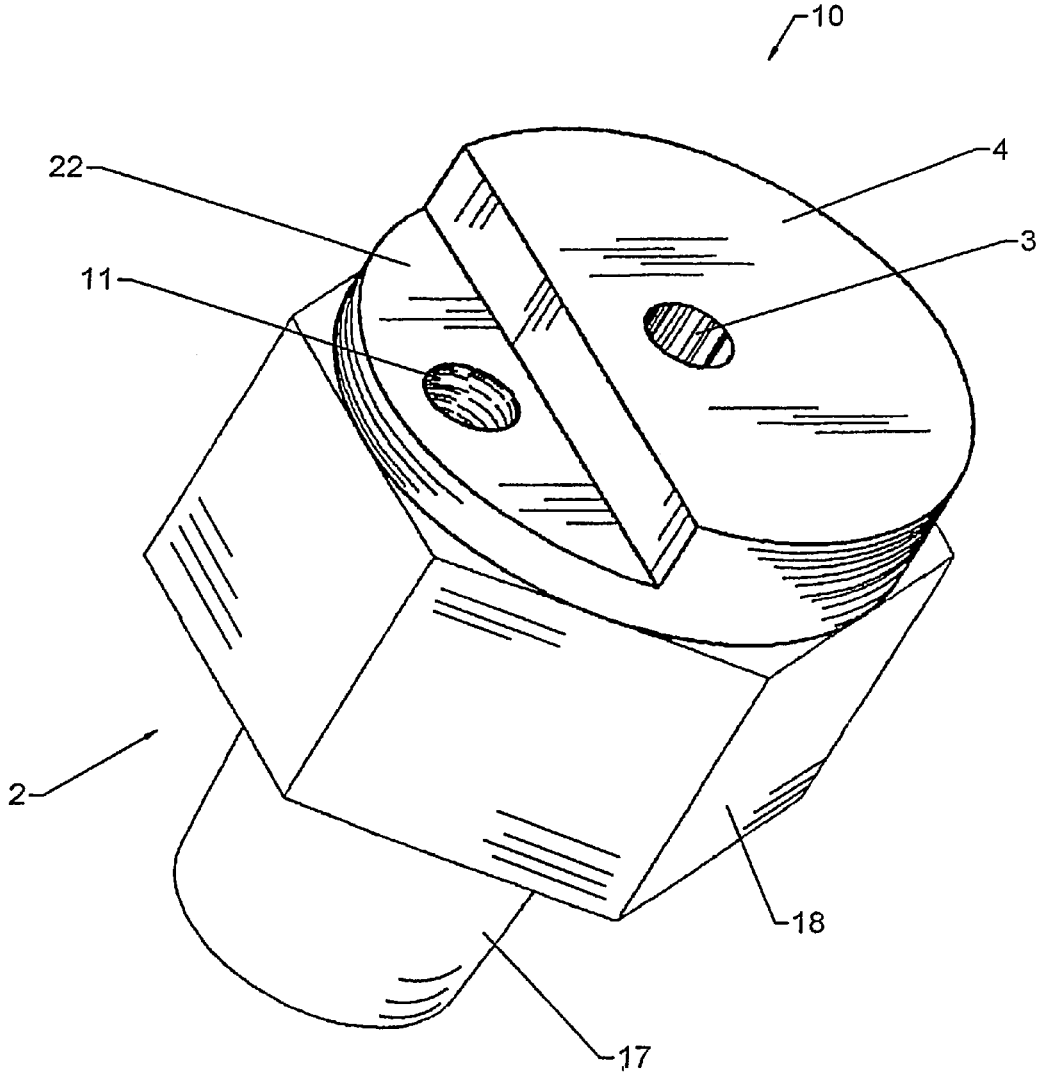
FIG. 2 is a perspective view of a nozzle body according to the present invention.

In one embodiment, the nozzle 1 is made of two pieces, a spray head 8 and a nozzle body 10. FIG. 2 illustrates one configuration of a nozzle body 10. The nozzle body 10 includes an orifice 3 and a discharge surface 4. The nozzle body 10 also includes a fluid fitting 2. The fluid fitting 2 may include a threaded shaft 17 and a hexagonal perimeter 18 suitable for tightening with a standard wrench. Other configurations of a fluid fitting 2 can be used that are well known in the art. For example, members that can serve as a fluid fitting 2 include a flange, a pneumatic-style quick disconnect, or a weldment.

Figure 3:
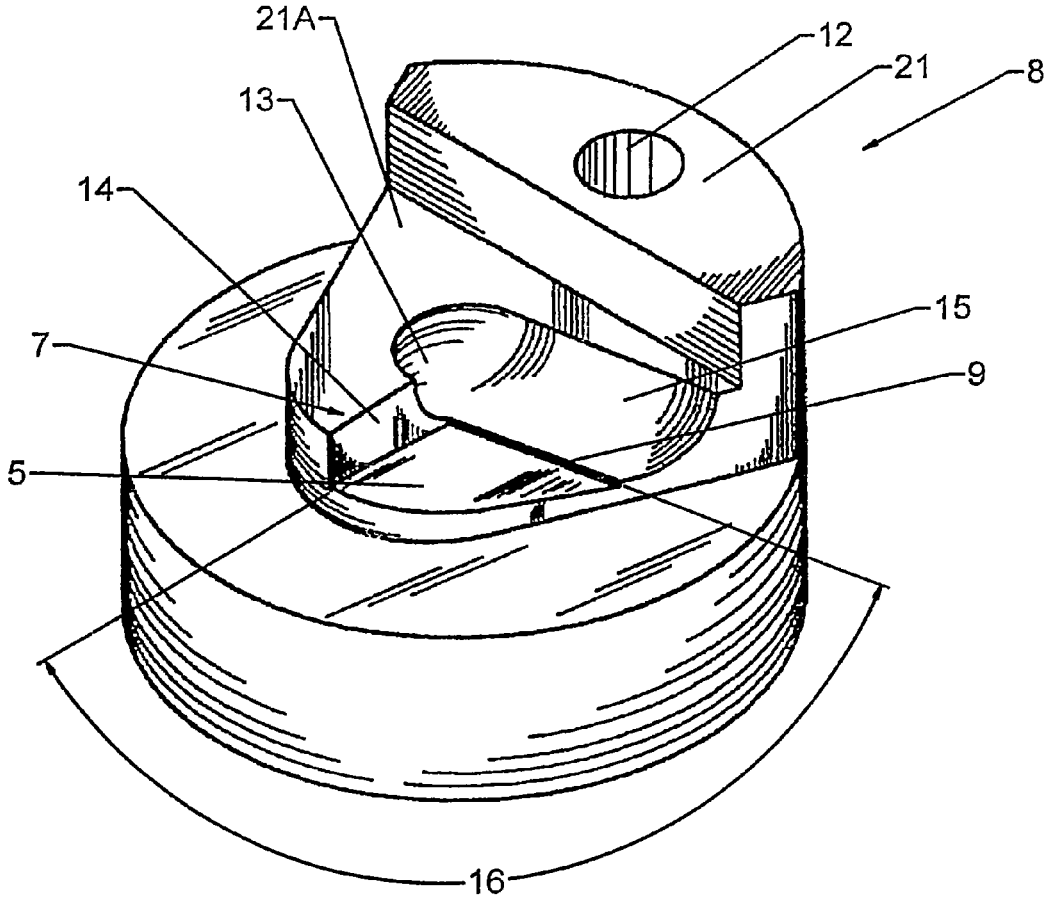
FIG. 3 is a perspective view of an embodiment of a spray head according to the present invention.

The body 10 also includes a mounting hole 11 and mounting surface 22 that can be used to interface with a spray head 8. One embodiment of a spray head 8 is shown in FIG. 3. The spray head 8 includes a mounting hole 12 and mounting surface 21 that lines up with the mounting hole 11 and mounting surface 22 on the body 10. The mounting holes 11, 12 are aligned so that the spray head 8 and body 10 can be assembled using a fastener such as a screw 19 (best seen in FIG. 1).

Referring again to FIG. 3, the spray head 8 includes a sealing surface 21A that interfaces with the body's discharge surface 4 when the spray head 8 and body 10 are mated together. The sealing surface 21A is generally triangular in shape, with a base of the triangle located adjacent the mounting surface and the tip opposite the base oriented towards the nozzle's direction of discharge. The tip of the triangular shaped sealing surface 21A has a rounded profile. The impingement surface 5 is formed as a planar indentation in the sealing surface 21A. The interface between the impingement surface 5 and the sealing surface 21A defines the deflection ridge 7. At least part of the deflection ridge 7 is adjacent to the triangular base of the sealing surface 21A, thereby deflecting fluid generally towards the rounded triangular tip of the sealing surface 21A.

In the embodiment illustrated in FIG. 3, the deflection ridge 7 is formed by the intersection of two features, a sharp corner 14 and a filleted corner 15. The sharp corner 14 and the filleted corner 15 intersect at an spray angle 16. The spray angle 16 influences the shape of the discharged fluid plume. The filleted corner 15 extends past the intersection of the filleted corner 15 with the sharp corner 14, such that a spherical indentation 13 is formed at the intersection. The spherical indentation 13 is located approximately near the impingement point of the flow leaving the orifice 3. The filleted corner 15 joins with the impingement surface 5 at a sharp ridge 9. The sharp ridge 9 can be formed as a substantially 90 degree corner line along the length of the filleted corner 15. Alternatively, the sharp ridge 9 may be formed by a wedge shaped ridge such that there is a smooth interface where the filleted corner 15 joins the impingement surface 5 near the spherical indentation 13, thereafter forming an increasingly deeper corner line as the sharp ridges extends towards the trailing edge of the filleted corner 15. The spray head 8 embodiment illustrated in FIG. 3 has been found especially useful for spray angles 16 ranging from about 80 degrees to about 120 degrees. It is appreciated that a mirror image arrangement of features shown in FIG. 3 would allow a similar spray pattern to be formed in a direction opposite of that shown in FIG. 3.

Figure 4:
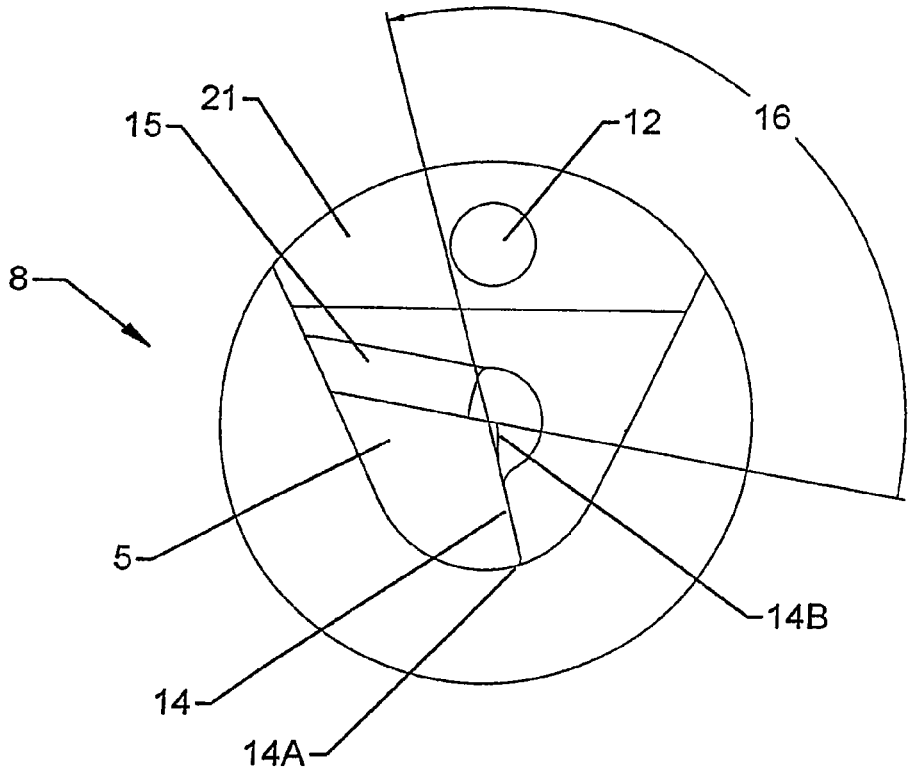
FIG. 4 is a plan view of an alternate embodiment of a spray head according to the present invention.

Turning now to FIG. 4, a spray head 8 similar to the embodiment shown in FIG. 3 is illustrated with additional features for improving spray dispersion characteristics. The spray head 8 includes a trailing edge curve 14A and a leading edge curve 14B located on the sharp corner 14. The trailing edge curve 14A is located at a distal (outward) end of the sharp corner 14, and extends inwards towards the filleted corner 15. The leading edge curve 14B is located near the intersection of the sharp corner 14 and the filleted corner 15, and extends away from the filleted corner 15. The vertical surface of the sharp corner 14 remains substantially perpendicular to the sealing surface 21A at both the trailing and leading edge curves 14A, 14B. It has been found that inclusion of trailing and leading edge curves 14A, 14B provides more even dispersion of fluid in nozzles with a spray angle of less that 140 degrees.

Figure 6:
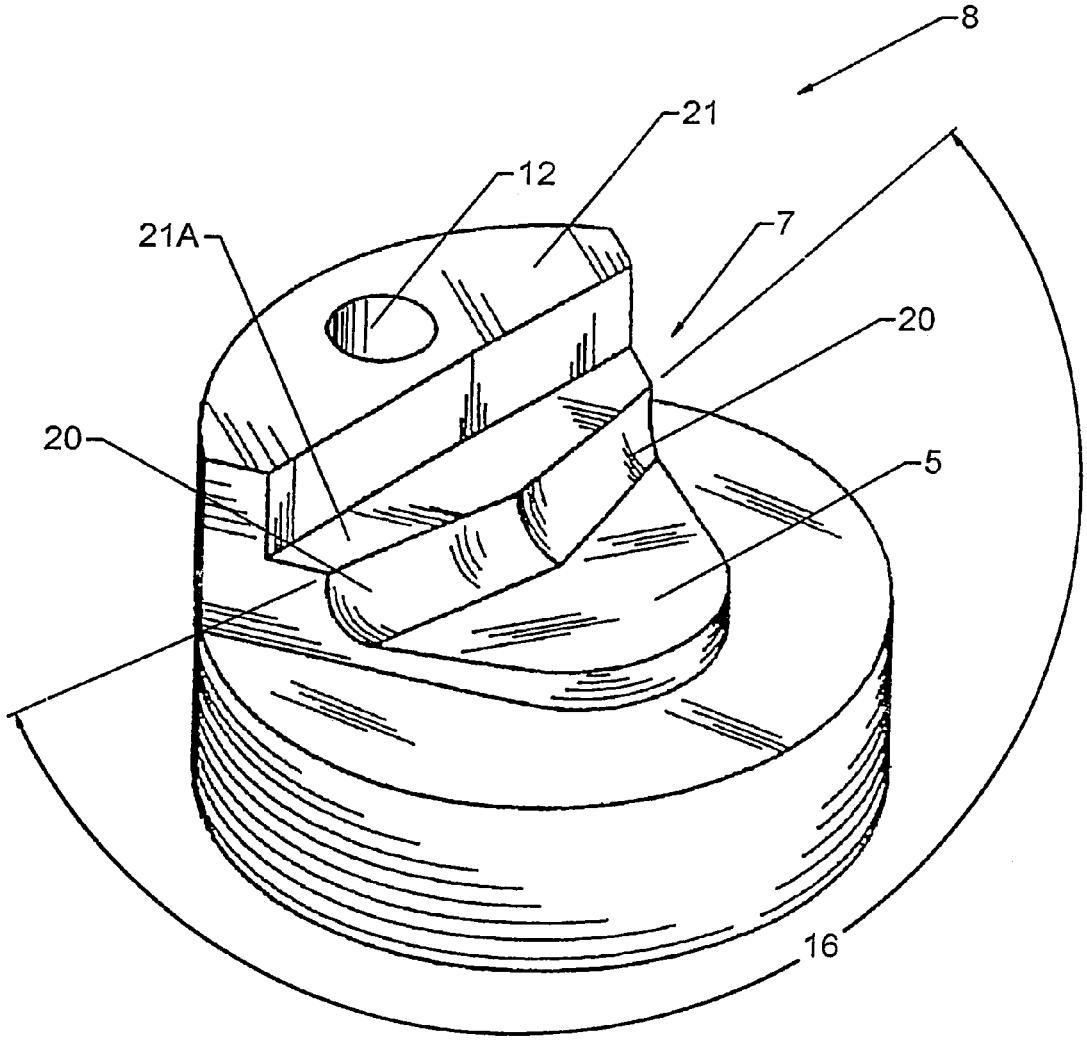
FIG. 6 is a perspective view of another embodiment of a spray head according to the present invention.

Another embodiment of a spray head 8 is shown in FIG. 6. In this embodiment, the deflection ridge 7 is formed by two filleted corners 20. The filleted corners 20 intersect at a spray angle 16. In this embodiment, the filleted corners 20 smoothly join with the impingement surface 5. This configuration is especially useful in spray angles 16 ranging from about 180 degrees to about 220 degrees.

Figure 7:
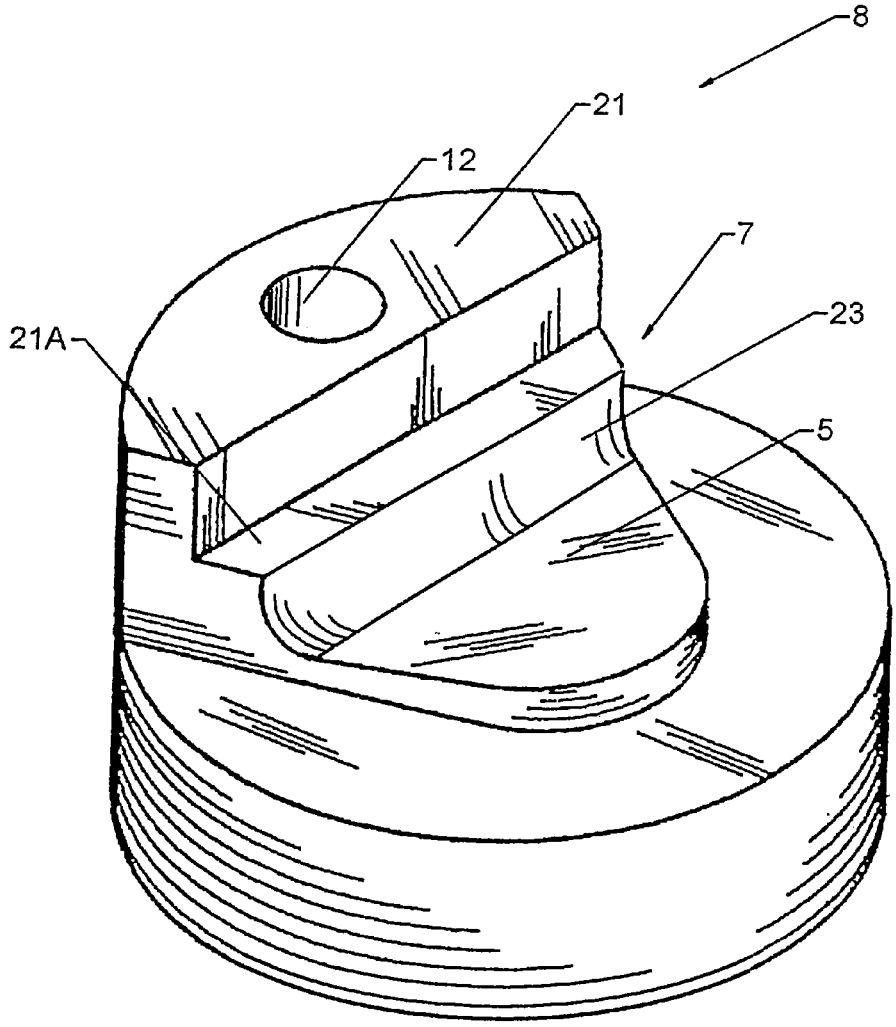
FIG. 7 is a perspective view of yet another embodiment of a spray head according to the present invention.

Yet another embodiment of a spray head 8 is shown in FIG. 7. In this embodiment, the deflection ridge 7 is formed by one filleted corner 23. The filleted corner 23 smoothly joins with the impingement surface 5. This configuration provides an approximately 180 degree spray pattern.

The spray heads 8 illustrated in FIGS. 3-7 include mounting holes 12 and interface surfaces 21 that are identically configured. This allows spray heads 8 of various geometries to be interchangeable on the body 10. Interchangeability of the spray head 8 allows for easy reconfiguration of a spray patterns on a system using a nozzle 1 according to the present invention. An interchangeable spray head 8 also allows for easy replacement of worn or damaged spray heads 8.

A nozzle 1 according to the present invention can be fabricated from a number of suitable materials. For discharge of liquids in an agricultural application, the nozzle 1 can be formed from a corrosion resistant steel such as 303 stainless steel. Other materials such as brass, carbon steel, aluminum, polymers and ceramics may be appropriate for the spray head 8 and/or the body 10 depending on the fluid to be discharged and the desired wear characteristics of the nozzle 1.

A configuration of a nozzle 1 according to the present invention is described hereinbelow that is particularly suited for discharging aqueous liquids into the atmosphere at a relative fluid pressure in a range of about 25 psi to about 35 psi. Such a configuration uses an orifice diameter of about 0.125 inches and a deflection angle 6 of about 85 degrees (±2 degrees). In such an application, a spray head 8 configured according to FIG. 3 includes a filleted corner 15 created using a 0.187 inch diameter ball end-mill cutting about 0.087 inches deep as measured from the sealing surface 21A. The spray head 8 in this example further includes a sharp ridge 9 with height of about 0.013 inches, the sharp ridge 9 being located at the interface between the filleted corner 15 and the impingement surface 5. The spray angle 16 is about 100 degrees. With the nozzle elevated about 36 inches from the ground, such an arrangement provides a spray pattern with even coverage to about 17 feet from the nozzle.

Figure 5:
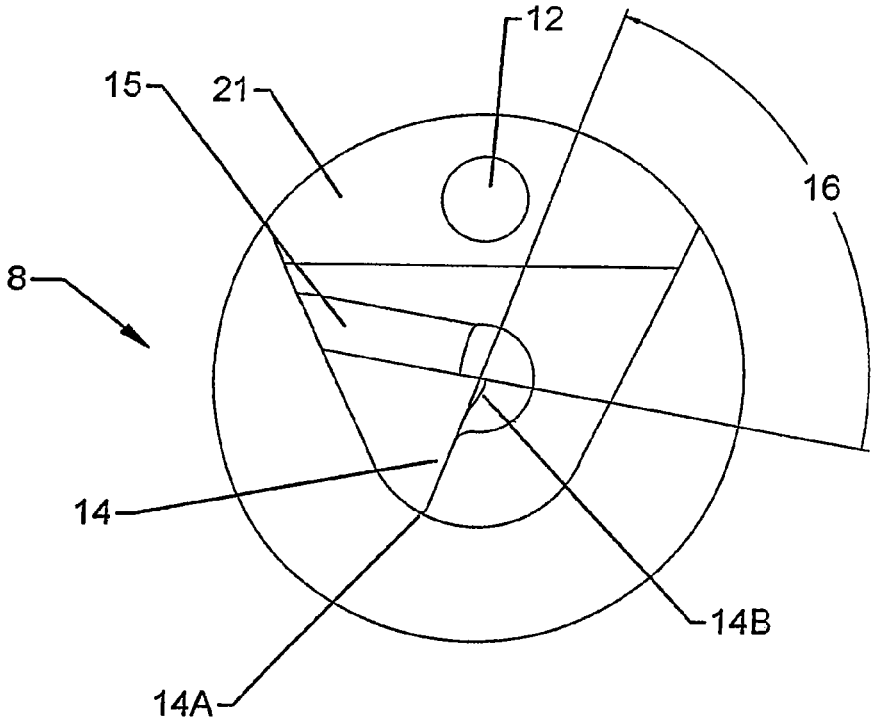
FIG. 5 is a plan view of an another embodiment of a spray head according to the present invention.

The spray head 8 illustrated in FIG. 4 has a geometry similar to that of FIG. 3, except that the spray angle 16 is about 115 degrees. This embodiment also includes a trailing edge curve 14A with diameter of about 0.063 inches. A leading edge curve 14B about 0.060 inches long and extends away from the apparent intersection of the sharp corner 14 and the filleted corner 15 by a maximum distance of about 0.011 inches. The spray head 8 shown in FIG. 5 is similarly configured, except the spray angle 16 is about 80 degrees.

In another similar application (i.e. 25-35 psi fluid pressure, 0.125 orifice diameter, and 85 degree deflection angle), a spray head configured according to FIG. 6 can provide an even distribution of fluid out to 22 feet from a nozzle elevated at about 40 inches from the ground. In this configuration, the filleted corners 20 are formed with a 0.187 diameter ball end-mill, the fillets smoothly interfacing with the impingement surface 5. The spray angle 16 in this configuration is about 200 degrees.

It will, of course, be understood that various modifications and additions can be made to the preferred embodiments discussed hereinabove without departing from the scope of the present invention. Accordingly, the scope of the present invention should not be limited by the particular embodiments described above, but should be defined only by the claims set forth below and equivalents thereof.

What is claimed is:

1. A fluid spray nozzle, comprising:

a discharge surface;

an orifice disposed on the discharge surface;

an impingement surface oppositely facing the orifice, the impingement surface oriented at an impingement angle measured relative to a centerline of the orifice, the impingement angle being less than 90 degrees whereby a portion of fluid will be deflected back to along the discharge surface;

a radiused deflection ridge, the deflection ridge bridging a gap between the impingement surface and the discharge surface, the deflection ridge defining a spray angle which limits the discharge of fluid; said orifice is laterally spaced apart from the deflection ridge and a fluid fitting in fluid connection with the orifice, the fluid fitting adapted to receive a pressurized fluid.

2. The spray nozzle of claim 1, wherein the deflection ridge comprises a filleted corner.

3. The spray nozzle of claim 2, wherein the filleted corner smoothly joins with the impingement surface.

4. The spray nozzle of claim 1, wherein the deflection ridge comprises two filleted corners, the filleted corners intersecting at an angle defining the spray angle.

5. The spray nozzle of claim 4, wherein the two filleted corners smoothly join with the impingement surface.

6. The spray nozzle of claim 4, wherein the spray angle is about 100 degrees to about 160 degrees.

7. The spray nozzle of claim 1, wherein the deflection ridge comprises a filleted corner and a sharp corner, the filleted corner and the sharp corner intersecting at an angle defining the spray angle.

8. The spray nozzle of claim 7, wherein the spray angle is about 90 degrees to about 120 degrees.

9. The spray nozzle of claim 7, wherein the filleted corner and the impingement surface join at a sharp ridge.

10. The spray nozzle of claim 7, wherein the filleted corner extends past the intersection of the filleted corner and the sharp corner and forms a spherical indentation therein.

11. The spray nozzle of claim 7, wherein the sharp corner further comprises a trailing edge curve, the trailing edge curve extending towards the filleted corner at a distal end of the sharp corner.

12. The spray nozzle of claim 7, wherein the sharp corner further comprises a leading edge curve, the leading edge curve extending away from the filleted corner at the intersection of the filleted corner and the sharp corner.

13. The system of claim 1, wherein the spray head is interchangeable on the body.

14. The nozzle of claim 1 wherein the deflection ridge is filleted and V-shaped.

15. The nozzle of claim 1 wherein the deflection ridge is filleted and bisected into two portions, the portions being in a non-linear angular relation to each other.

16. A method of constructing a fluid dispersal nozzle, having a discharge surface, an orifice in the discharge surface, and an impingement surface comprising:

a. providing an orifice for conducting a pressurized fluid onto an impingement surface, b. locating the impingement surface at a deflection angle measured relative to a centerline of the orifice, the angle being 90 degrees or less;

c. deflecting the fluid along a radiused deflection ridge bridging a gap between the impingement surface and the discharge surface;

d. locating the orifice orthogonally relative to the discharge surface; and e. limiting the cross sectional extent of the impingement surface so that its extent is less than the extent of the discharge surface; so that fluid exiting the orifice will generally strike the impingement surface and subsequently flow along the discharge surface before being discharged from the nozzle.

17. The method of claim 16, wherein the deflection angle is generally 85 degrees.

18. The method of claim 16, wherein restricting the exit plume to a limited circumferential angle further comprises deflecting the impingement flow using a filleted corner.

19. The method of claim 16, wherein limiting the exit plume to a limited circumferential angle further comprises deflecting the impingement flow using two filleted corners, the filleted corners intersecting at an angle defining the spray angle.

20. The method of claim 19, wherein the spray angle is about 100 degrees to about 160 degrees.

21. The method of claim 16, wherein limiting the exit plume to a limited circumferential angle further comprises deflecting the impingement flow using a filleted corner and a sharp corner, the filleted corner and the sharp corner intersecting at an angle defining a spray angle.

22. The method of claim 21, wherein the spray angle is about 80 degrees to about 120 degrees.

23. The method of claim 16, wherein the fluid is pressurized in a range from about 25 psi to about 35 psi.

24. A spray nozzle, comprising:

a discharge surface;

an orifice disposed on the discharge surface;

an impingement surface oppositely facing the orifice, the impingement surface oriented at an impingement angle measured relative to a centerline of the orifice, the impingement angle being less than 90 degrees;

a radiused deflection ridge, the deflection ridge bridging a gap between the impingement surface and the discharge surface, the deflection ridge defining a spray angle which limits the discharge of fluid; said orifice is aligned so that fluid exiting the orifice first strikes the impingement surface and then may flow, at least in part, to the deflection ridge and then along the discharge surface before exiting the nozzle;

a fluid fitting in fluid connection with the orifice, the fluid fitting adapted to receive a pressurized fluid.

25. A spray nozzle with a limited spray circumference for spraying a fluid in a predetermined spraying angle, comprising:

a substantially planar discharge surface;

central orifice substantially orthogonally disposed on the discharge surface;

a deflection ridge, having an upper and lower edge, said lower edge extending from said planar surface and being formed to limit the fluid flow by its curved surface;

an impingement surface, extending from the upper edge of said deflection ridge and oppositely facing the orifice, the impingement surface oriented at an impingement angle measured relative to a centerline of the orifice, the impingement angle being less than 90 degrees; said impingement surface having a peripheral edge and wherein said discharge surface also has a peripheral edge, said edge extending beyond said impingement surface peripheral edge, so that fluid flow flowing along said impingement surface will generally be flow along said discharge surface before exiting the nozzle;

the deflection ridge bridging a gap between the impingement surface and the discharge surface, the deflection ridge defining a spray angle which limits the discharge of fluid; and a fluid fitting in fluid connection with the orifice, the fluid fitting adapted to receive a pressurized fluid.

* * * * *